United States Patent [19]

Ro et al.

[11] 4,314,849

[45] Feb. 9, 1982

[54] MAXIMIZING THE CORROSION RESISTANCE OF TIN CONTAINING STAINLESS STEEL POWDER COMPACTS

[75] Inventors: David H. Ro, Cleveland Heights; Erhard Klar, Beachwood; C. I. Whitman, Bay Village, all of Ohio

[73] Assignee: SCM Corporation, New York, N.Y.

[21] Appl. No.: 113,584

[22] Filed: Jan. 21, 1980

Related U.S. Application Data

[63] Continuation-in-part of Ser. No. 10,956, Feb. 9, 1979, Pat. No. 4,241,831.

[51] Int. Cl.[3] ..... B22F 3/00; C22C 33/02; C22C 38/02

[52] U.S. Cl. ..... 75/228; 75/251; 75/245; 75/200; 75/224; 75/128 G; 75/128 E

[58] Field of Search ..... 75/200, 224, 128 G, 75/128 E, 243, 228, 251

[56] References Cited

U.S. PATENT DOCUMENTS 4,240,831 12/1980 Ro ..... 75/228

FOREIGN PATENT DOCUMENTS 52-35708 3/1977 Japan .

OTHER PUBLICATIONS

Powder Metallurgy Equipment Manual 1977 pp. 134, 135 & 138.

*Primary Examiner*—Brooks H. Hunt

*Attorney, Agent, or Firm*—Robert A. Sturges; Merton H. Douthitt

[57] ABSTRACT

The corrosion resistance of stainless steel powder compacts containing tin and silicon is maximized if the compacts are sintered at temperatures in excess of 2300° F. in highly reductive atmospheres until the ratio of Sn:Si on the surface of the compact is at least about 1:1. Stainless steel powders atomized in an oxidizing atmosphere and containing up to about 1 percent oxygen can be utilized.

13 Claims, No Drawings

MAXIMIZING THE CORROSION RESISTANCE OF TIN CONTAINING STAINLESS STEEL POWDER COMPACTS

This is a continuation-in-part of Ser. No. 010,956 filed on Feb. 9, 1979 now U.S. Pat. No. 4,241,831.

BACKGROUND OF THE INVENTION

The present invention relates to powder metallurgy (P/M) stainless steel powders and compacts therefrom, and more particularly to maximizing the corrosion resistance of tin containing stainless steel powder compacts.

Heretofore, poor corrosion resistance of stainless steel powder compacts has been attributed mainly to the porosity within the compacts, thus most techniques for overcoming corrosion problems have been aimed at closing the porosity. Prior techniques aimed at minimizing the surface porosity of the compacts made from such stainless steel powders include mechanical closure treatment, plastic impregnation, surface coatings, or passivation techniques. Each of these techniques has some limitation as to its effectiveness, in addition to raising the cost of the final product. Other proposals have aimed at improving the corrosion resistance of stainless steel powder compacts by changing the compacting and sintering parameters. These proposals generally state that the sintering conditions and sintering atmosphere have a marked influence on the corrosion properties of the powder compact; however, most of the experimental results reported in these proposals are inconsistent. For example, Kalish and Mazza ("An Evaluation of Dissociated Ammonia and Hydrogen Atmospheres for Sintering Stainless Steel", *Journal of Metals,* Trans. AIME, February 1955, pages 304–310) state that sintering in hydrogen provides a more corrosion resistant compact than sintering in dissociated ammonia. Stosuy et al (*Metal Progress,* Vol. 91, pages 81–85, 1967) and Jones ("The Effect of Processing Variables on the Properties of Type 316-L Powder Compacts", *Progress in Powder Metallurgy,* Vol. 30, pages 25–50, April, 1974) report that an optimum combination of mechanical properties and corrosion resistance of the compact can be obtained by sintering the compact in dissociated ammonia. Furthermore, Sands et al ("The Corrosion Resistance of Sintered Austenitic Stainless Steel", *Modern Developments in Powder Metallurgy,* Vol. 2, H. H. Hausner, ed., Plenum Press, New York, N.Y., pages 73–83, 1966) report that while sintering in vacuo always gives a good corrosion resistant product, sintering in either dissociated ammonia or hydrogen can lead to loss of corrosion resistance.

Japanese Tokkai 52-35708, now Japanese Pat. No. 79-29285 to Daido Steel Company, Ltd., reports that the addition of a small amount of tin and optionally tin plus copper to stainless steel powder during atomization or prior to compacting while maintaining a regular rear spherical shape for the powder can improve the corrosion resistance of stainless steel powder compacts made therefrom. Certainly, the inconsistencies among these various citations demonstrate that confusion is prevalent in the art and prevent the making of any generalizations—or the combination of teachings with regard to the corrosion resistance of stainless steel powder and compacts made therefrom.

In accord with the present invention, it has now been discovered that stainless steel powders atomized in an oxidizing atmosphere (e.g. a conventional water atomization process) are very irregular and surface-enriched in silicon oxides (primarily silicon dioxide) and, thus, surface depleted in chromium. Further, if this stainless steel powder contains tin, the corrosion resistance of such alloys can be maximized if the powder compacts are sintered to produce a critical tin:silicon ratio on the surface of the powder compact. One advantage of the present invention is that it provides a method of improving corrosion resistance without adding processing steps. Another benefit is that expensive alloying additions such as molybdenum can be replaced by less expense alloying additions of tin or tin plus copper. Another benefit of the present invention is that the compressibility of stainless steel powders can be enhanced. Still other benefits will be obvious from the detailed description of the invention.

SUMMARY OF THE INVENTION

The present invention is a process for maximizing the corrosion resistance of a stainless steel powder compact containing silicon and tin. The process comprises sintering the compact at a temperature not substantially below about 2300° F. and at a dew point not substantially above about −60° F. for a time sufficient for establishing a tin:silicon ratio on the surface of said compact of at least about 1.0:1.0. Another aspect of the present invention is a powder particularly adapted for use in the above process which powder was atomized in an oxidizing atmosphere and has an irregular shape. Yet another aspect of the present invention is the resulting corrosion resistant stainless steel compact produced.

DETAILED DESCRIPTION OF THE INVENTION

Stainless steel alloys can generally be described as ferrous alloys which contain substantial amounts of nickel and/or chromium. Other elements that can be present in conventional stainless steel powders include carbon, oxygen, silicon, aluminum, manganese, and others. The alloys of the present invention further contain a small proportion of tin and optionally an additional small proportion of copper.

To be effective in the present invention, stainless steel powder should contain at least about 0.5% silicon and can contain up to about 2%. If the silicon level is too low, the stainless steel powder tends to oxidize excessively during atomization and if the silicon level is too high, the compressibility and other forming parameters of the powder are detrimentally effected. Preferably a silicon level between about 0.7 and 1.0% is used.

The present alloys also can contain from about 0.01–5% tin. Tin becomes enriched about the surface of the stainless steel powder and further enriches about the surface during sintering. Surface enrichment includes the surface and about 0.01 and up to about 1 micrometer into the powder itself. Tin also promotes the removal of silicon oxides from the surfaces of stainless steel powder or compact during sintering. It is not known whether the silicon oxides are reduced to silicon monoxides, for example, and volatilized from the stainless steel during sintering, or reduced to elemental silicon which rediffuses into the powder or compact thereof during the sintering operation. Likely, both of these results are occurring. The precise reaction mechanisms or reasons for this phenomenon are not fully understood.

It has been found that if stainless steel powder compacts containing silicon and tin are sintered at high temperatures in relatively low dew point atmospheres until a critical ratio of tin:silicon on the compact surface is obtained; the corrosion resistance of such a compact can be maximized. If the critical ratio is not obtained, then the corrosion resistance of the resulting compact will be significantly lower than for compacts sintered under these special conditions. Further, it has been found that these sintering conditions allow conventionally atomized powder produced in oxidizing atmospheres to reach the critical ratio of tin:silicon at the compact's surface and thus realize their full corrosion-inhibiting potential.

Other components in the alloy composition must also be considered when making corrosion resistances stainless steel powder compacts. The carbon level of the alloys should be maintained at less than about 0.03%. During the sintering cycle carbon will migrate to the grain boundaries and form chromium carbides. The formation of these carbides depletes the alloy of chromium in the area surrounding the carbides. These areas of low chromium content are very susceptible to corrosion and are often referred to as being "sensitized". Also, powders atomized in oxidizing atmospheres will contain oxygen. Oxygen should be present, but as with many components, oxygen should not be allowed to become excessive. Excessive oxides tend to decrease the compressibility of the alloy powder during compacting; however, if no oxides are present at all, green strength of the compacts will be extremely low and extra processings will be required. About 0.2–1% oxygen will be present after typical atomization in an oxidizing atmosphere. This is a satisfactory amount, and amounts in the range from less than about 0.1% to about 1.5% are also acceptable. Generally, special precautions to control the oxygen content of the powder during atomization will not be required with the present process. This is a distinct advantage over previous suggestions which required that the oxygen content of similar alloys be limited to a maximum of 0.4%. However, in accord with the present invention alloys containing, for example, 0.6–1.0 percent oxygen and even higher are also useful for making corrosion resistant stainless steel powder compacts. For further information about stainless steel powders, reference is made to the AISI series of stainless steel grades for amplification on particular elements comprising various stainless steel alloys suitably formulated into "powder metallurgy" stainless steel powders.

Water atomization is the preferred manufacturing process for producing stainless steel powders (a powder metallurgy process), though various gas atomization processes may be used. U.S. Pat. No. 2,956,304 depicts a typical water atomization process and the method for practice of this process. The stainless steel particles average size (weight average diameter) typically is less than 325 mesh, though the distribution of particles can range from finer than this on up to 100 mesh and larger (United States Standard Sieve Series).

Because of the oxidizing environment prevailing during the water atomization or like procedure (e.g. gas atomization with water or wet collection) for manufacturing stainless steel powders, the powder and the compact thereof are enriched in various oxides of some of the metals used to form the stainless steel alloy. Some of these oxides are enriched about the surface of the powder. Although the total concentration of oxygen in the alloy typically is only about 0.2–1.0%, the concentration of oxides such as silicon oxide about the surface of the powder can be as high as about 20%–40% by weight. It also should be noted that other oxides can form from the atomization process and some of these additionally can be enriched about the surface of the stainless steel particles. Such other additional oxides can contribute to undesirable properties in the powder and such other oxides preferably are reduced simultaneously in the present invention by the presence of tin and during reductive sintering to be described below. An example of such other undesirable metal oxide is manganese oxide which significantly contributes to discoloration of the stainless steel powder and compact thereof.

Experimental testing indicates that corrosion resistance of stainless steel powder or a compact thereof increases with decreasing proportions of silicon oxides about the surface of the powder. Specifically, for tin and silicon containing stainless steel powder and compacts, the corrosion resistance can be maximized if special sintering conditions are used to generate a critical ratio of tin:silicon on the surface of the compact of at least about 1.0:1.0. This discovery not only allows attaining the full potential of these alloys for corrosion resistance, but also provides a process for obtaining good corrosion resistance from alloys which previously were unusable because they contained excessive oxygen. Precise values for calculating this ratio are difficult to determine due to analytical equipment limitations in accurately measuring small quantities of metals (or oxides) on the surface of the powder, but reasonable accuracy is attainable.

Stainless steel powders are compacted for forming a wide variety of parts. Compacting by consolidation, unidirectional die, isostatic techniques, rolling techniques, laboratory techniques, optionally with extrusion, all are suitable for forming parts. Further information on compacting techniques can be found in Kirk-Othmer, *Encyclopedia of Science and Technology,* Vol. 16, Second Edition, pages 401–435, Inner Science Publishers, New York, N.Y. (1968). Densification from about 60% of theoretical density on up to full dense parts is practiced. Typical compacts are made by consolidation under pressures of about 5–8 t/cm$^2$ producing compacts having from about 70–95% of theoretical density, and preferably about 80–84%.

An important characteristic of stainless steel powder for formation into compacts is its compressibility. Desirably, stainless steel powders have high compressibility so that the desired density can be reached at the lowest possible pressure during compacting. A small decrease in compressibility can require a large increase in pressure to obtain the same density in the compact produced. Further, as the compacting pressure is increased the wear on the dies and forming equipment increases rapidly. In one aspect of the present invention, copper is added to the stainless steel powder alloys to enhance compressibility. Additions of up to about 3% copper are effective for this purpose without detrimentally affecting the strength or other characteristics of the compacts produced.

Lubricants such as lithium stearate or zinc stearate are frequently used during compacting to increase the die life and decrease the pressure required to obtain the desired density. If a lubricant is used, it must be burned out before the sintering step. Burn-out at about 800° F.–1200° F. for about ½ hour is effective for this purpose.

Another consideration in the compacting procedure should be the minimization of carbon pickup during processing. As previously mentioned, carbon can be detrimental to the corrosion resistance of stainless steel powder compacts. Extraneous materials in the dies or incomplete lubricant burn-out can contribute to the carbon pickup and the compacting procedures should be designed to minimize the possibility of this contamination.

An important aspect of the present invention is the sintering of the stainless steel powder compact. Sintering temperatures of at least about 2300° F. and reducing atmospheres having dew points of lower than about −60° F. should be used. Further, sintering under these conditions should continue until the ratio of tin:silicon on the powder compact surface is about 1:1. Sintering times of about ½ hour to 1 hour are effective for this purpose. However, the sintering time can be as high as 2–3 hours under some circumstances. The sintering temperature should not exceed the melting point of the stainless steel alloy in the powder. Exceeding this temperature will cause the microstructure of the powder to be destroyed and the compact to lose its shape and melt.

The specific atmosphere utilized during sintering is not critical as long as a dew point of lower than about −60° F. can be maintained. Hydrogen and dissociated ammonia atmospheres as well as vacuum sintering can be utilized. Typically, however, these atmospheres have dew points in the range of about −40° F. to about −60° F. Therefore, special precautions have to be taken to insure that the dew point remains below about −60°. The use of a hydrogen purifier or a molecular sieve plus dryer is generally effective for this purpose. The hydrogen purifier will catalytically react any free oxygen present in the hydrogen atmosphere to form water vapor which is then trapped in a sieve and then removed by a dryer. Similarly, the molecular sieve plus dryer combination will trap the water vapor in the atmosphere and remove it by drying. If a vacuum is employed, a partial pressure of about 100–300 microns total can be effective if the partial pressure of water is sufficiently low to produce the desired dew point. Back-filling the vacuum with a prepared gas is frequently practiced. Again, it may be desirable to use a dryer for the back-filled gas when using a vacuum sintering operation. In each case, the dew point can be measured with a Type 7000 dew pointer, manufactured by Elnor Instrument Company.

The sintering time should be at least about ½ hour to obtain effective bonding of the particles. Sintering times of up to at least one hour can be used with dissociated ammonia and hydrogen atmospheres, and up to about 2–3 hours for vacuum sintering. The extended time for vacuum sintering is allowable because there is a smaller chance of detrimental side reactions with hydrogen or nitrogen under the vacuum conditions.

The mechanism by which the desired tin:silicon ratio is established is not clearly understood at this time. However, it is believed that the tin migrates to the surface of the stainless steel powder and remains at the surface relatively stable during reductive sintering, whereas the silicon oxide present at the surface tends to be moved from the surface by some mechanism. As a result, as reductive sintering proceeds, the ratio of tin:silicon on the surface increases with time. When the ratio is greater than about 1:1, it has now been found that the corrosion resistance of the sintered compact is maximized. An additional benefit of the present invention is that the maximized corrosion resistance values produced are more consistent than values produced by following the teachings in the art. A further benefit to following the parameters for the present reductive sintering process is that powder compacts can be formed at lower pressures and having a lower green density. Subsequently during the reductive sintering process aspect of the present invention, greater than usual densification occurs so that the desired final density is achieved.

The following examples show ways in which the present invention has been practiced. In this application, all parts and percentages are by weight, all temperatures are in degrees Fahrenheit, and all other units are in the metric system unless otherwise expressly indicated.

IN THE EXAMPLES

In the examples, the stainless steel powder was Type 304-L having the following typical chemical and sieve analysis:

TABLE I

| Elements | Weight Percent |
|---|---|
| C | .02 |
| Si | .8 |
| Mn | .2 |
| Cr | 18.5 |
| Ni | 11.5 |
| Fe | Balance |

TABLE II

| Powder Fraction (Tyler Mesh) | Weight Percent |
|---|---|
| >100 | 2 |
| 100/150 | 8 |
| 150/200 | 15 |
| 200/325 | 25 |
| <325 | 50 |

The powder was produced by a conventional water-atomization technique in a nitrogen atmosphere.

Specimens approximately 32×13×3 mm were compacted to about 85% of theoretical density in a double acting die set. Normally, 1% lithium stearate was used as an admixed lubricant during compaction. Green compacts were subjected to a burn-off treatment at 1000° F. for 30 minutes in air prior to sintering. Sintering was conducted by placing the specimens in stainless steel boats.

Corrosion tests were carried out in 5% salt spray tests conducted according to ASTM B 117–64 for 96 hours.

Surface analyses were performed using electron spectroscopy for chemical analysis (ESCA) and Auger electron spectroscopy (AES) techniques. ESCA work was conducted on the VIEE-15 electron spectrometer equipped with electrostatic analyzers. (Varian Analytical Instrument Devices, Inc.). Auger analyses were performed on the AES system (PHI Model 510, Physical Electronics, Perkin-Elmer, Inc.) and the SAM-/ESCA system, a combination of the ESCA/Auger electron spectrometer and the scanning Auger microprobe.

EXAMPLE 1

Water-atomized 304-L stainless steel powder containing 0.85% Sn was formed into compacts and sintered under various conditions in a dissociated ammonia atmosphere. Surface tin:silicon ratios were determined by AES techniques. The sintered compacts were then corrosion tested as described above. Data are shown in Table III.

TABLE III

| | | |
|---|---|---|
| Powder | 304-L + .85 Sn | 304-L + .85 Sn |
| Sintering Temperature | 2150° F. | 2400° F. |
| Dew Point | −30° F. | −90° F. |
| Sintered Density | 6.55 | 7.0 |
| Sn/Si Ratio at Surface | 0.06 | 3.41 |
| % of Samples with No Corrosion | 0 | 25 |
| % of Samples with 1% Corrosion | 0 | 75 |
| % of Samples with 2–25% Corrosion | 60 | 0 |
| % of Samples with >25% Corrosion | 40 | 0 |

EXAMPLE 2

Water-atomized 304-L stainless steel powder and similar powder containing 1% tin and 2% copper were compacted and sintered under similar conditions. The green density, green strength, Transverse rupture strength, ultimate tensile strength, percent elongation, Rockwell hardness ($R_B$), and percent dimensional change were measured and are shown in Table IV. The tin plus copper containing powder has a superior compressibility to the regular 304-L powder as shown by its higher green density achieved under similar pressing conditions. This property plus its enhanced corrosion resistance could make this alloy a suitable replacement for conventional 316-L alloy. This represents a significant cost savings since 316-L contains the very expensive component molybdenum and 304-L does not.

TABLE IV

| Alloy | Regular 304-L | 304-L with 1% Sn and 2% Cu |
|---|---|---|
| Green Density (g/cc) | 6.53 | 6.67 |
| Green Strength (psi) | 6.20 | 12.70 |
| Transverse Rupture Strength (psi) | 123,270 | 118,830 |
| Ultimate Tensile Strength (psi) | 41,970 | 66,800 |
| Percent Elongation | 5.3 | 7.0 |
| Hardness ($R_B$) | 65 | 59 |
| Percent Dimensional Change | −0.32 | −0.18 |

Further about the irregular shape of the present stainless steel powder. Stainless steel powders containing silicon which are atomized in oxidizing atmospheres tend to have very irregular shapes. The silicon has a high affinity for oxygen and silicon oxides rapidly form on the surface of the powder.

Frequently these powders have a mean long-to-short ratio of 2:1 or greater, based on the dimensions of discrete powder particles. Some irregularity is desirable to achieve good green strength. However, extreme irregularity, and the attendant high level of surface oxides can be detrimental to the compressibility of the powder.

What is claimed is:

1. A process for maximizing the corrosion resistance of a low carbon stainless steel powder compact containing at least about 0.5% silicon and a predetermined amount of tin of at least about 0.01% which comprises, sintering said compact at a temperature not substantially below about 2300° F. at a dew point of at least about −60° F. for a time sufficient for establishing a tin:silicon ratio on the surface of said compact of at least about 1:1, while substantially preserving the microstructure of the powder contained therein, said time being at least ½ hour.

2. The process of claim 1 wherein said powder compact further contains copper in an amount up to 3%.

3. The process of claim 1 wherein said predetermined amount of tin is between about 0.5 to about 5%.

4. The process of claim 1 wherein said powder compact is made from irregularly-shaped powder having a long-to-short ratio of at least about 2:1.

5. The process of claim 3 wherein said compact contains about 0.7 to about 1.0% silicon.

6. The stainless steel powder compact of claim 1 wherein said powder was atomized in an oxidizing atmosphere and contains about 0.6 to about 1.0% oxygen.

7. The sintered stainless steel powder compact of claim 1.

8. The sintered stainless steel powder compact of claim 6.

9. An irregularly-shaped, low-carbon, corrosion-resistant stainless steel powder atomized in an oxidizing atmosphere containing at least about 0.01% tin, at least about 0.5% silicon, about 0.6–1.0% oxygen, and up to about 3% copper.

10. The powder of claim 9 having a long-to-short ratio of at least about 2:1.

11. The powder of claim 9 which contains about 0.5 to about 5% tin.

12. The powder of claim 11 which contains about 0.7 to about 1.0% silicon.

13. A coherent compact of the powder of claim 9 formed under pressure.

* * * * *